United States Patent [19]

McClymonds

[11] Patent Number: 4,835,889

[45] Date of Patent: Jun. 6, 1989

[54] SIGN HOLDER

[76] Inventor: Bruce J. McClymonds, 18778 San Pasqual, Fountain Valley, Calif. 92708

[21] Appl. No.: 8,850

[22] Filed: Jan. 30, 1987

[51] Int. Cl.[4] ..... G09F 7/02

[52] U.S. Cl. ..... 40/611; 40/490

[58] Field of Search ..... 40/16 R, 488–491, 40/611, 15 R, 10 R, 618.17

[56] References Cited

U.S. PATENT DOCUMENTS

| | | | |
|---|---|---|---|
| 391,765 | 10/1888 | Terrill | 40/489 |
| 758,088 | 4/1904 | Mixer | 40/611 |
| 935,191 | 9/1909 | Day | 40/611 |
| 1,127,223 | 2/1915 | Fogle | 40/611 |
| 1,450,751 | 4/1923 | Quigley | 40/585 |
| 1,462,390 | 7/1923 | Stayig | 40/585 |
| 1,821,053 | 9/1931 | Dietz et al. | 40/202 |
| 2,102,972 | 12/1937 | Phillips | 40/611 |
| 3,651,591 | 3/1972 | Woodyard | 40/537 |
| 3,660,918 | 5/1972 | Bourseau | 40/585 |
| 3,750,313 | 8/1973 | Notaro | 40/611 |
| 3,826,026 | 7/1974 | Bevan | 40/16 |
| 3,838,529 | 10/1974 | Aybar | 40/611 |
| 3,924,344 | 12/1975 | Davis | 40/611 |
| 4,048,738 | 9/1977 | McHenry | 40/16 |
| 4,413,434 | 11/1983 | Rupert et al. | 40/16 |
| 4,463,924 | 8/1984 | Conti | 40/607 |
| 4,679,341 | 7/1987 | Goldman | 40/611 |

FOREIGN PATENT DOCUMENTS

| | | | |
|---|---|---|---|
| 367701 | 2/1963 | Switzerland | 40/489 |

*Primary Examiner*—Robert P. Swiatek
*Assistant Examiner*—Michael Lynch
*Attorney, Agent, or Firm*—Sheldon & Mak

[57] ABSTRACT

A sign holder holds a plurality of sign elements. The sign holder comprises an optically transparent planar front panel, a planar rear panel parallel to the front panel, and a peripheral frame situated between the front and rear panels and attached thereto, forming a display space between the front and rear panels within the circumference of the frame. The sign holder has opposed sides, a top and a bottom and includes an access slot in one of its sides near the bottom, the height of the access slot being less than the height of the frame so that a plurality of signs each shorter than the sign holder can be inserted into and removed from the display space via the access slot. The sign holder also has a side hole in the side opposite from the access slot, so that a pusher can be inserted into the side hole for pushing a sign element out of the display space via the access hole. There is a bottom hole in the bottom of the sign holder for receiving a tool for pushing a sign upwardly in the display space so that another sign can be inserted into the display space via the access slot.

12 Claims, 2 Drawing Sheets

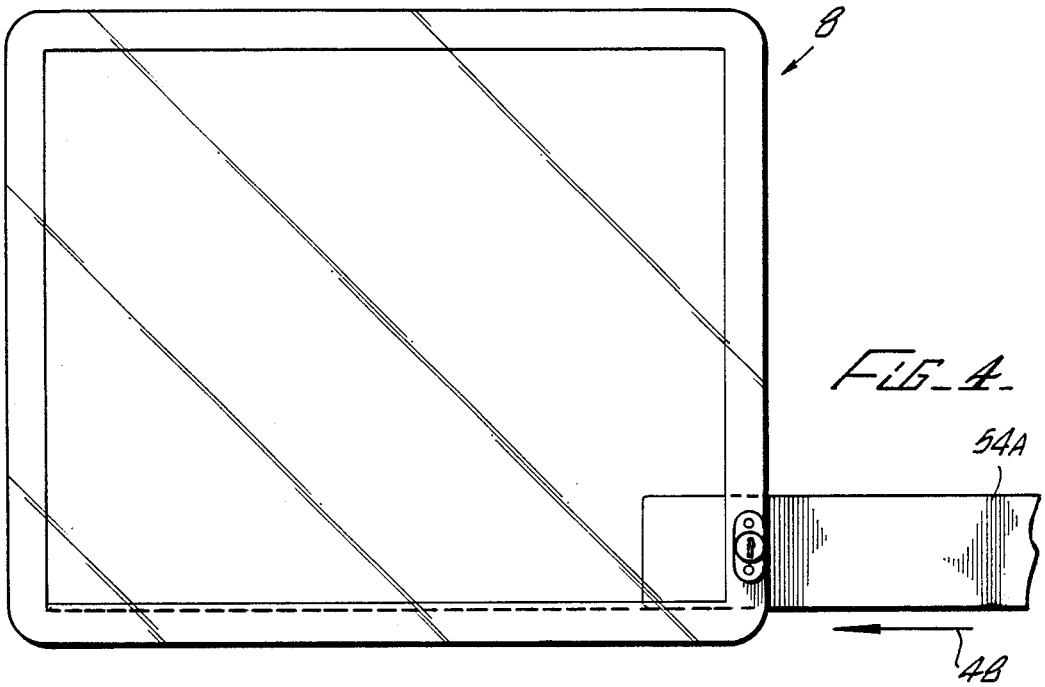
FIG. 4.
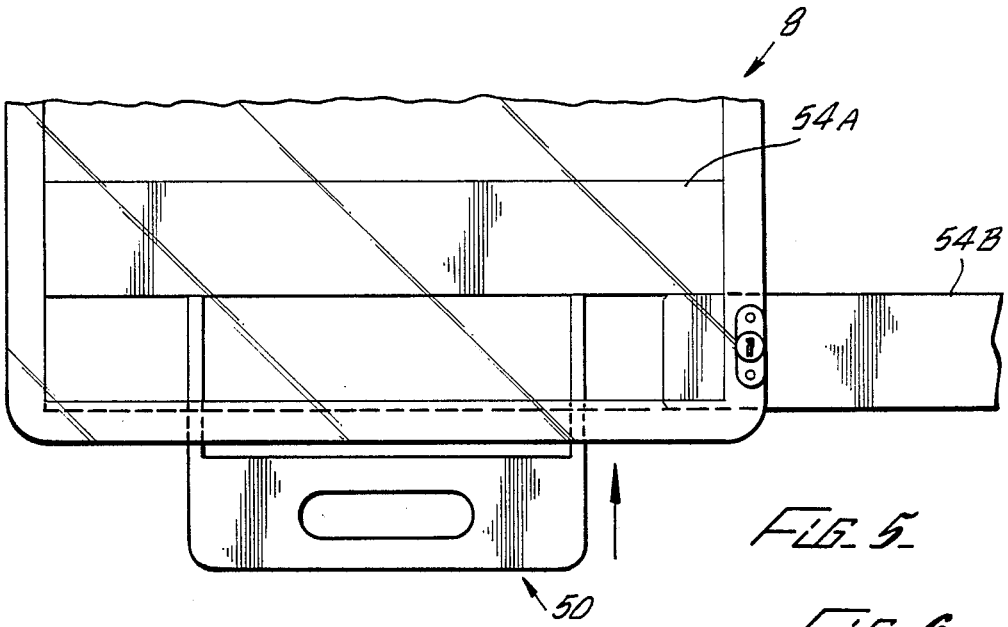
FIG. 5.
FIG. 6.
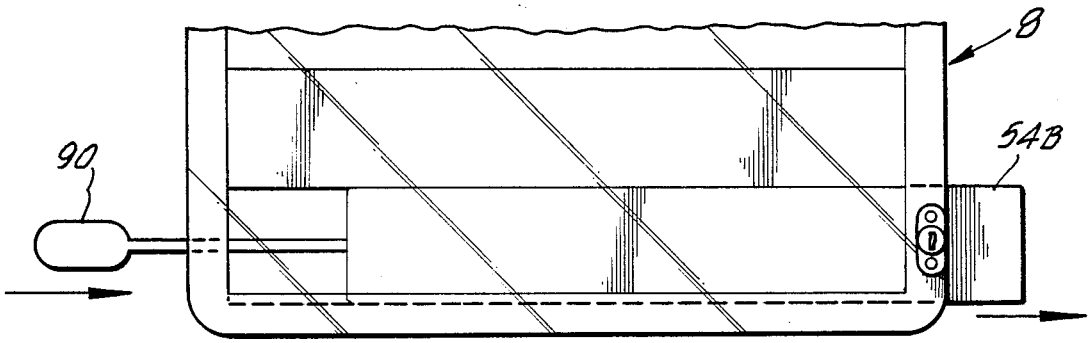

SIGN HOLDER

BACKGROUND

The present invention relates to sign holders and sign elements.

Conventional sign holders that completely enclose the sign elements have either moving or removable parts. These parts can be a source of problems in that moving parts can break or corrode.

Further, removable parts in a sign holder give rise to problems such as the removable part can be lost, and removable parts can result in unauthorized access to the sign elements in the sign holder. This is particularly a problem at nuclear power plants and other industrial sites where the sign holders are used to post safety signs. It is important that only authorized persons can post, take down, or otherwise change sign elements at nuclear power plants and other industrial sites.

A further problem with conventional sign holders is that they are either so heavy or constructed in such a way that in order to mount them on a vertical surface such as a door or wall, it is necessary to penetrate the surface. This is unsatisfactory for many applications. For example, at nuclear power facilities and other industrial sites, safety signs are posted on fire doors. Under various safety codes, fire doors can not have any object penetrating the door. Thus conventional sign holders cannot be used for this type of application.

Another problem with conventional sign holders is that they are typically made of materials which can rust, shatter, crack, yellow, or otherwise deteriorate with age and/or exposure to heat, cold, light, and moisture Therefore, there is a need for a sign holder with no moving or removable parts in which the sign elements can be changed only by authorized personnel and which is made out of a material which will not rust, shatter, crack, yellow or otherwise deteriorate, and is light enough and constructed in such a way that it can be mounted on fire doors or other vertical surfaces without penetration of the surface.

The present invention is directed to a sign holder which overcomes these problems A sign holder according to the present invention is adapted for holding a plurality of individual sign elements and comprises (i) an optically transparent front panel, (ii) a rear panel parallel to the front panel, and (iii) a peripheral frame between the front and rear panel. These three elements enclose a display space. The sign holder has opposed sides, a top and a bottom. The sign holder has an access slot in one of its sides near the bottom for inserting and removing sign elements from the holder. The height of the access slot is less than the height of the holder and greater than the height of the sign elements.

The sign holder also has a side hole in its side opposite from the access slot so that a pushing tool can be inserted into the hole for pushing a sign element out of the display space via the access slot. In addition, there is at least one bottom hole in the bottom of the sign holder for receiving a tool for pushing a sign element upwardly in the display space so another sign element can be inserted into the display space via the access slot.

The sign holder can be used in conjunction with a tool comprising at least one prong sufficiently small to fit into the bottom hole and the side holes in the frame. The tool can be used for pushing a sign into the display space by being inserted into the bottom hole and as a pusher for pushing a sign out of the display space via the access slot.

Preferably, the sign holder is of unitary construction with the front and rear panels and the frame being substantially permanently assembled together Preferably, the entire sign holder is made of a plastic which is lightweight and which does not rust, shatter, crack, yellow, or otherwise deteriorate with age or exposure to light, heat, cold or moisture A preferred plastic is polycarbonate

DRAWINGS

These and other features, aspects, and advantages of the present invention will become better understood with reference to the following description, appended claims and accompanying drawings where:

FIG. 4 is a front view of the sign holder of FIG. 1 showing insertion of a sign element;

Figure 1:
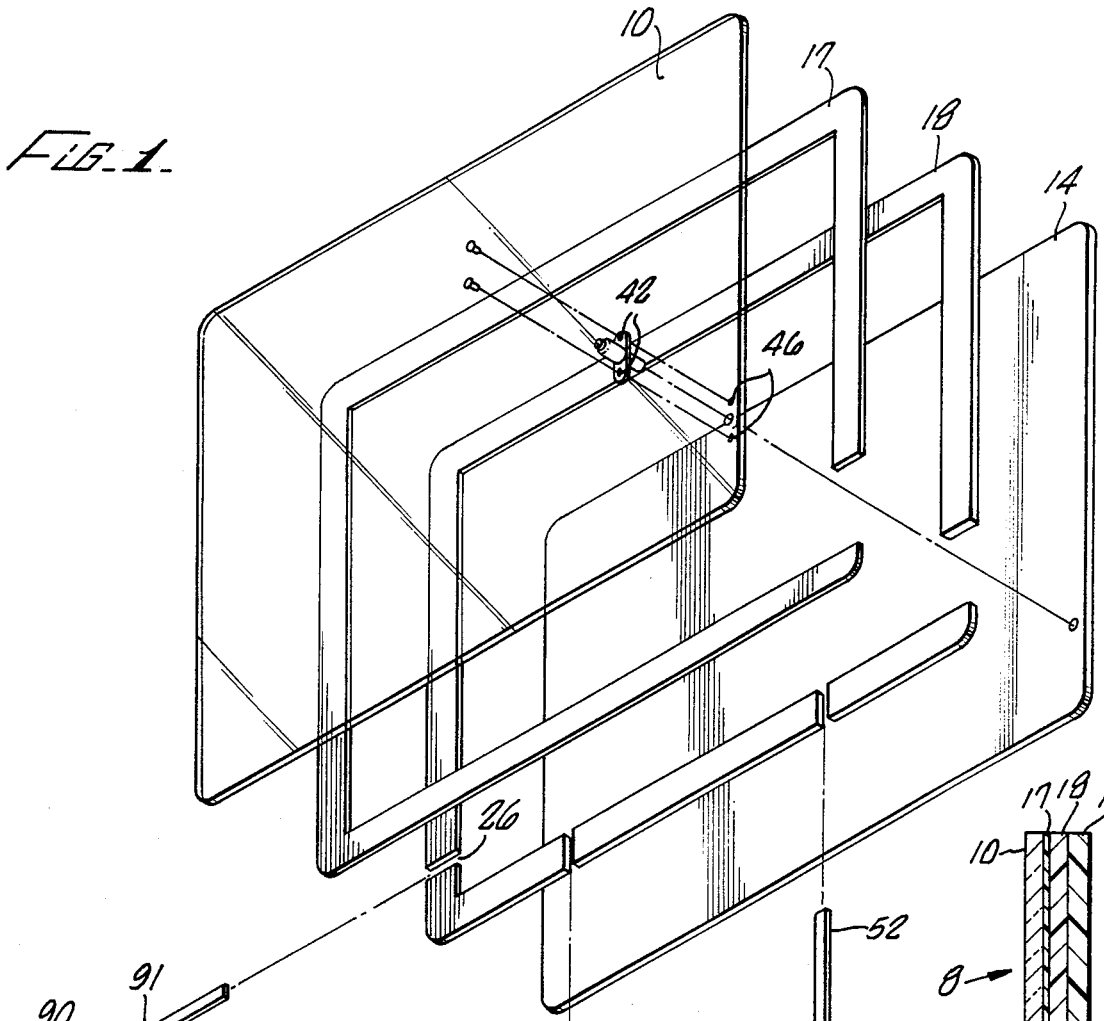
FIG. 1 is an exploded perspective view of a sign holder having features of the present invention, with the figure also showing two versions of a sign removal and pushing tool, a onepronged version and a two-pronged version suitable for use with the sign holder.

FIG. 5 is a front view of the lower portion of the sign holder of FIG. 1 showing insertion of the two-pronged version of the pushing tool of FIG. 1 into the bottom holes of the frame to move a sign element upwardly in the display space; and FIG. 6 is a front view of the lower portion of the sign holder of FIG. 1 showing how the one-pronged version of the pushing tool of FIG. 1 can be used to remove a sign element from the display space by pushing it out of the access slot.

DESCRIPTION

Figure 2:
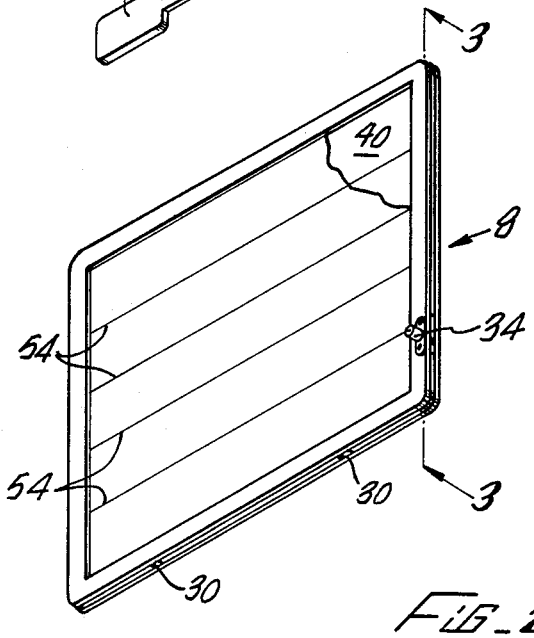
FIG. 2 is a perspective view of the assembled sign holder of FIG. 1 with a lock.

The present invention is directed to a sign holder. With reference to FIG. 1, a sign holder 8 embodying features of the present invention comprises a front panel 10, a rear panel 14, frame 18, and a frame shim 17. With reference to FIG. 2, when the front panel 10 and rear panel 14 are assembled with the frame 18 and frame shim 17 between them, they form a display space 40 bounded by the front panel 10, the rear panel 14, the frame 18 and the frame shim 17.

With further reference to FIG. 1, the sign holder 8 is assembled by attaching the front panel 10 to the rear panel 14, with the frame 18 and frame shim 17 between them. This can be done by holding the front panel and rear panel parallel to each other with the frame 18 and frame shim 17 sandwiched in between them and rivetting or gluing the entire frame. Alternatively, the frame 18 and frame shim 17 can be joined to each other and to the front panel 10 by rivetting or gluing. The front panel 10-frame 18-frame shim 17 assembly is joined to the rear panel 14. The joining of the front panel 10, the rear panel 14 and the frame 18-frame shim 17 into a unitary sign holder can be done by a plastic bonding cement or by rivets which substantially permanently join them.

In the alternative, the sign holder 8 could comprise a front panel molded in one piece with a frame. Because the sign holder 8 is vertically mounted on a surface, the vertical surface can serve as the back panel of the sign holder.

The frame 18 and frame shim 17 have an access slot 22 cut into one side. The access slot is shorter in height than the sign holder 8.

The frame 18 has a side hole 26 on the side of the frame opposite from the access slot 22.

The frame 18 has at least one bottom hole 30.

With reference to FIG. 1, the sign holder 8 is used with a pushing tool. Two versions of the pushing tool are illustrated. Pushing tool 50 has two prongs 52 and a gripping handle 53. Pushing tool 90 has one prong 91. Prongs 52 and 91 are small enough to be inserted into bottom hole or holes 30 and into the side hole 26 in the sign holder 8.

With reference to FIG. 4, a sign element 54A can be inserted into the display space 40 via the access slot 22 in the direction of an arrow 48. With reference to FIG. 5, once the sign element 54A has been inserted into the display space 40, an additional sign element 54B can be inserted into the display space 40 by first pushing the sign element 54A upwardly within the display space 40 by inserting the prongs 52 of the tool 50 into the bottom hole or holes 30 and pushing the sign element 54A upwardly in the display space 40, then inserting the additional sign element 54B via the access slot 22.

With reference to FIG. 6, the sign element 54B can be removed from the display space 40 by inserting the prong 91 of the tool 90 into the side hole 26 opposite the access slot 22, pushing the sign element 54B out of the display space via the access slot 22. Once the sign element 54 is removed by being pushed out of the display space 40 via the access slot 22, the remaining sign element 54A in th display space falls downwardly in the display space due to gravity.

Figure 3:
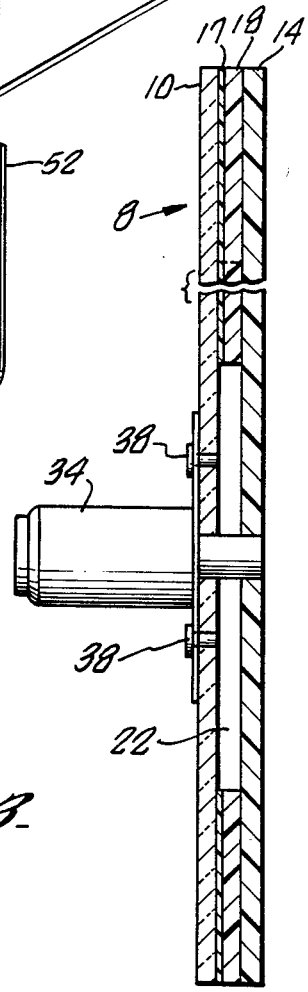
FIG. 3 is a side vertical sectional view of the sign holder of FIG. 2 taken along line 3—3 in FIG. 2, with a portion of the front panel removed to show a display space.

With reference to FIGS. 1, 2, and 3, a blocking means for the access slot 22 such as a lock assembly 34 can be attached to the sign holder 8. The lock assembly 34 can be attached to the sign holder 8 by rivets 38 which are rivetted through holes 42 in the lock and holes 46 in the front panel. Rivets are preferable to screws for attaching the lock assembly 34 to the sign holder 8 because they attach the lock substantially permanently to the sign holder. An alternate way of attaching the lock 34 to the sign holder is to glue it so that it is substantially permanently attached to front panel 10 of the sign holder 8. Screws could be removed thus defeating the tamper-proof nature of the sign holder.

The lock assembly 34 blocks the access slot 22 when in the locked position as seen in FIG. 3.

The front panel 10 and rear panel 14 can be of identical size and shape. The frame 18 and frame shim 17 can have outer dimensions and shape equal to the outer dimensions and shape of the front panel 10 and rear panel 14.

The front panel 10 is colorless and substantially optically clear; the rear panel 14 is opaque so that light does not enter from the rear of the sign and shine on the sign elements 54A and 54B making them more difficult to see.

Preferably, the edges of the sign holder are rounded for use at industrial sites where OSHA requires that the corners of signs be rounded.

The front panel 10, rear panel 14, frame 18 and frame shim 17 can be made of plastic. Preferably, a polycarbonate plastic is used because polycarbonate plastic:

(1) does not yellow, rust, crack, shatter, or otherwise deteriorate from exposure to heat, cold, light, or moisture;

(2) the panels and frame can be glued together using a plastic bonding cement such that they are substantially permanently joined;

(3) as shown in more detail below, a sign holder made entirely of polycarbonate plastic is light enough to be easily mounted by gluing to a vertical surface. This is especially important in industrial sites such as nuclear power facilities where the sign holder is mounted on fire doors which cannot be penetrated.

The front panel 10 and the rear panel 14 can have a thickness in the range of from about 1/16 to about ¼ inch. The preferable thickness for the panels is about ⅛ inch thick. Advantages of using ⅛ thick plastic include:

(1) ⅛ inch plastic is readily commercially available;

(2) plastic thinner than about ⅛ inch tends to deform with temperature changes. The effect of deformation is that the display space 40 is distorted and either becomes too large allowing the sign elements 54A and 54B to slip over each other, or too small so that the sign elements 54A and 54B are not able to move freely within the display space;

(3) where the front panel 10 and rear panel 14 are greater than about ⅛ inch thick, the sign holder 8 can be too heavy to mount on a vertical surface by gluing, making it unsuitable for use on fire doors.

The sign holder 8 can have the dimensions of 20 inches wide by 16½ inches high. Where the sign holder 8 has these dimensions and where the front panel 10 and rear panel 14 are made of polycarbonate plastic of ⅛ inch thickness, the sign weighs less than 6 lbs. when full of sign elements and is thus light enough to be easily mounted by gluing on a vertical surface. 20 inches wide by 16½ high is also a convenient size for holding sign elements 54 which carry safety signs. A sign holder 8 with such dimensions can hold 5 sign elements 54 each 3 inches tall and 18½ wide. The sign element ean be 3 inches high by 18½ inches wide. Such a sign element can contain a 3 inch square safety symbol on its right-hand side and still have room for wording. It has been shown that safety symbols which are 3 inches square can be seen from a distance of approximately 25 feet and written words on 3 inch high signs can be seen from about 10 feet.

The sign elements 54A and 54B have a thickness in the range of between about 1/16 inch to about ¼ inch thick. Polycarbonate plastic is a preferable material for the sign elements, since it is both lightweight and will not deteriorate. Preferably, the thickness of the sign elements 54 is ⅛ inch. The ⅛ inch sign elements are thick enough so that they do not deform with changes in temperature and yet are light enough to be part of a sign holder/sign combination which can be easily mounted on a vertical surface by gluing.

With reference to FIG. 1, the frame 18 has a thickness in the range of about 1/16 inch to about ¼ inch. Preferably, it is ⅛ (0.125) inch thick. The frame shim is about 0.04 inch thick. Thus, the frame 18 and frame shim 17 are preferably 0.165 inch thick when joined together. This leaves just enough room in the display space 40 for the sign elements 54A and 54B of ⅛ inch (0.125 inch) thickness so that the sign elements 54A and 54B do not slip over each other but move easily within the display space 40.

Although the present invention has been described in considerable detail with reference to certain versions thereof, other versions are possible. Therefore, the spirit and scope of the appended claims should not necessarily be limited to the description of the preferred versions contained herein.

What is claimed is:

1. A sign holder displaying a plurality of sign elements, the sign holder having opposed sides, a top and a bottom and comprising:

(a) an optically transparent planar front element;

(b) a planar rear element parallel to the front element;

(c) a peripheral frame situated between the front and rear elements and attached thereto, forming a display space between the front and rear elements within the circumference of the frame;

(d) an access slot in one of the sides proximate to the bottom, the height of the access slot being less than the height of the frame so that each of the sign elements is shorter than the access slot and is removably disposed in the display space between the front and rear elements by passing through the access slot;

(e) a side hole in the side of the sign holder opposite from the access slot, so that a pusher can be inserted into the side hole for pushing one of the sign elements out of the display space via the access slot, the side hole being shorter in height than the access slot; and (f) at least one bottom hole in the bottom of the sign holder for receiving a tool for pushing one of the sign elements upwardly in the display space so another of the sign elements can be inserted into the display space via the access slot.

2. The sign holder of claim 1, in which the front and rear elements and the peripheral frame are all made of the same material.

3. The sign holder of claim 2, in which the front and rear elements and frame are all made of plastic.

4. The sign holder of claim 2 or 3 in which the front and rear elements and frame are substantially permanently joined together.

5. The sign holder of claim 1, comprising a plurality of the bottom holes, the bottom holes being spaced apart.

6. The sign holder of claim 1 including a removable blocking means for the access slot which can be opened and closed and in closed position blocks the access slot to prevent a sign element from being removed from the display space via the slot.

7. The sign holder of claim 6 in which the removable blocking means is a lock.

8. An assembly comprising:

(a) the sign holder described in claim 1; and (b) a tool comprising at least one prong sufficiently small to fit into the bottom and side holes in the sign holder which prong can be used both for pushing a sign in the display space upwardly by being inserted into the bottom hole, and as a pusher for pushing a sign element out of the display space via the access slot by being inserted into the side hole.

9. An assembly as claimed in claim 8 comprising a plurality of the bottom holes, the bottom holes being spaced apart and wherein the tool includes a pair of spaced prongs, spacing of the prongs being equal to the spaced apart bottom holes.

10. An assembly comprising;

a. the sign holder described in claim 1; and b. at least one sign element having a thickness slightly less than the width of the display space so that the sign element can move freely within the sign holder but does not overlap any other sign element and shorter in height than the access slot, so that the sign element can be removably inserted into the display space via the access slot.

11. A sign holder as claimed in claim 1 wherein there is a single access slot for receiving the plurality of sign elements.

12. A sign holder displaying a plurality of sign elements, the sign holder having opposed sides, a top, and a bottom and comprising:

(a) an optically transparent planar front element;

(b) a planar rear element parallel to the front element;

(c) a peripheral frame situated between the front and rear elements and attached thereto, forming a display space between the front and rear elements within the circumference of the frame;

(d) an access slot in one of the sides proximate to the bottom, the height of the access slot being less than the height of the frame so that each of the sign elements is shorter than the access slot and is removably disposed in the display space between the front and rear elements by passing through the access slot;

(e) a side hole in the side of the sign holder opposite from the access slot, so that a pusher can be inserted into the side hole for pushing one of the sign elements out of the display space via the access slot, the side hole being shorter in height than the access slot;

(f) at least one bottom hole in the bottom of the sign holder for receiving a tool for pushing one of the sign elements upwardly in the display space so another of the sign elements can be inserted into the display space via the access slot, the bottom hole being shorter in width than one of the sign elements whereby the sign elements are not received through the bottom hole and;

(g) a lock for opening and closing the access slot wherein in a closed position the lock blocks the access slot to prevent unauthorized removal of sign elements from the display via the slot.

* * * * *